US006533021B1

(12) United States Patent
Shibata et al.

(10) Patent No.: US 6,533,021 B1
(45) Date of Patent: Mar. 18, 2003

(54) MOLD FOR HOT-RUNNER INJECTION MOLDING MACHINE AND METHOD FOR MANUFACTURING THE SAME

(75) Inventors: Itsuo Shibata, Hiratsuka (JP); Takashi Mizushima, Yokohama (JP); Ryoichi Sekiguchi, Kanagawa (JP)

(73) Assignees: Ju-Oh Inc., Hiratsuka (JP); The Japan Steel Works Ltd., Tokyo (JP)

( * ) Notice: Subject to any disclaimer, the term of this patent is extended or adjusted under 35 U.S.C. 154(b) by 0 days.

(21) Appl. No.: 09/662,028

(22) Filed: Sep. 14, 2000

Related U.S. Application Data

(63) Continuation of application No. PCT/JP00/00646, filed on Feb. 7, 2000.

(30) Foreign Application Priority Data

Feb. 10, 1999 (JP) ..... 11-032105

(51) Int. Cl.[7] ..... B22D 17/02
(52) U.S. Cl. ..... 164/312; 164/347
(58) Field of Search ..... 164/113, 312, 164/347, 131

(56) References Cited

U.S. PATENT DOCUMENTS 3,572,424 A * 3/1971 Byrne ..... 164/347
3,672,437 A * 6/1972 Bennett ..... 164/265
4,609,138 A * 9/1986 Harrison ..... 228/161
4,726,751 A * 2/1988 Shibata et al. ..... 425/144

FOREIGN PATENT DOCUMENTS

| | | |
|---|---|---|
| JP | 62-144851 | 6/1987 |
| JP | 9-85416 | 3/1997 |
| JP | 11-936 | 1/1999 |

* cited by examiner

*Primary Examiner*—M. Alexandra Elve
*Assistant Examiner*—Len Tran
(74) *Attorney, Agent, or Firm*—Kanesaka & Takeuchi

(57) ABSTRACT

A mold for a metal hot-runner injection molding machine includes a movable mold plate, a fixed mold plate having a nozzle for injecting molten metal into said cavity, and a heating device disposed outside the nozzle for heating metal. A gate cut portion is situated in the nozzle between the heating device and the tip. A temperature measurement device is arranged adjacent to the gate cut portion for measuring the temperature of the metal in the gate cut portion. A heating control device is connected to the heating device for controlling a temperature of the nozzle on a basis of the temperature measurement device. A heat insulation device is arranged on the nozzle to cover at least an area where the gate cut portion is formed. By controlling the temperature of the nozzle, metal injection molding without runner can be made.

9 Claims, 8 Drawing Sheets

MOLD FOR HOT-RUNNER INJECTION MOLDING MACHINE AND METHOD FOR MANUFACTURING THE SAME

CROSS REFERENCE TO RELATED APPLICATION

This is a continuation application of PCT International Application of PCT/JP00/00646 filed on Feb. 7, 2000.

TECHNICAL FIELD

The present invention relates generally to a mold for a hot-runner injection molding machine, and more particularly, to a mold for a hot-runner injection molding machine, adapted for injection molding of metal having a higher melting point and a higher thermal conductivity than resin.

BACKGROUND ART

Due to its capability of molding products without runners and sprues, the runnerless injection molding method has a remarkable advantage over the cold-runner system injection molding. Such a runnerless injection molding is suited to injection molding of resin having a relatively low melting point and a low thermal conductivity. The runnerless injection molding method is thus in wide use for the resin injection molding.

FIG. 9 is a sectional view of a mold for a hotrunner injection molding machine making use of induction heating.

The mold comprises a fixed mold plate 3' having thereon mounted a nozzle 1' and a manifold 2', and a movable mold plate 4' having a cavity 4*a'* shaped correspondingly to the shape of products. The cavity 4*a'* is formed in a heat-resistant metallic core 6' attached to the movable mold plate 4', whilst a metallic core 5' corresponding to the metallic core 6' is attached to the fixed mold plate 3'.

A back plate 8' is mounted behind (upper side in FIG.9) the fixed mold plate 3', with the manifold 2' being arranged in a space 7' that is defined between the back plate 8' and the fixed mold plate 3'. The fixed mold plate 3' and the metallic core 5' are formed with a nozzle fitting hole 3*a'* extending from the space 7' toward the cavity 4*a'* of the movable mold 4'. The nozzle 1' is inserted from the space 7' into the nozzle fitting hole 3a'.

A coil (not shown) is wound around the nozzle 1' so that the material within the nozzle 1' is heated by induction heating by the coil.

By the way, the above mentioned mold of the hotrunner injection molding machine is exclusively used for resin injection molding, although it would theoretically be applicable also to injection molding of metals such as magnesium alloy, aluminum alloy and zinc alloy.

For example, Japan Patent Laid-open Publication No. Hei 9-85416 proposes a hot-runner mold capable of injection molding of metal materials such as magnesium alloy, aluminum alloy and zinc alloy.

In characteristics, however, the above metals have a melting point of 400° C. to 700° C. which is fairly higher than that of resin, and have a fairly higher thermal conductivity than that of resin.

Accordingly, direct application to molten metal injection molding of the existing mold of the hot-runner injection-molding machine for use with resin will pose problems, which follow.

(1) Due to an extremely large difference in temperature between the high-temperature molten metal (material) and the mold, simultaneously with the injection molding the heat of the material is rapidly absorbed by the mold in contact with the nozzle and by the product solidified in the cavity. Thus, for solidifying, the temperature of the material in the gate cut portion drops to the vicinity of the mold temperature, which is fairly lower than the melting point of that material. For this reason, in order to melt the material in the gate cut portion to open the gate cut portion for the next injection, the material in the nozzle runner needs to be heated up to several hundred degrees or above. This means that much time is spent on opening the gate, and it may disturb the high-cycle operation.

(2) Meanwhile, upon the mold opening after the injection molding, the temperature of the material within the gate cut portion and the nozzle in proximity thereto needs to be dropped to a sufficiently low level for solidifying. Otherwise, the molten material may leak out of the nozzle tip or molten material lying behind the gate cut portion may be ejected from the nozzle tip.

(3) In the invention as recited in Japan Patent Laid-open Publication No. Hei 9-85416 described above, the gate is formed with a 0.1 to 0.5 mm dia. circular hole or slit so that the flow resistance of the molten metal passing through the gate becomes higher than the residual pressure of the molten metal material existing in the flow passage, to thereby prevent the molten metal from leaking out of the gate.

Due to the constant exposure of the molten material from the gate, however, any leakage of the molten material is apt to occur upon the mold opening.

From the above reasons, in spite of its higher material yield and productivity, the metal injection molding by the hot-runner injection molding machine was extremely difficult to practice in actuality.

The present invention has been conceived in order to solve the above problems and to make the hot-runner injection molding applicable to metals as well. It is therefore an object of the present invention to provide a mold for a hot-runner injection molding machine suitable for the injection molding of molten metal such as molten magnesium alloy and capable of injecting metal by securely blocking the gate cut portion with solidified metal upon the mold opening and by rapidly opening the gate cut portion upon the next injection molding.

SUMMARY OF THE INVENTION

The above object is attained by a mold having a gate cut portion whose position has been selected in an appropriate manner.

According to the present invention, there is provided a mold for a hot-runner injection molding machine, the mold being provided with a movable mold plate having a cavity and with a fixed mold plate having a nozzle for injecting molten metal into the cavity and having heating means for heating metal existing in the nozzle, the mold comprising temperature measurement means arranged in the vicinity of a gate cut portion where gate cutting is performed, for measuring the temperature of metal in the gate cut portion; heating control means for providing a control of heating of the nozzle effected by the heating means, on the basis of the result of measurement by the temperature measurement means; the gate cut portion formed on the nozzle at a predetermined position thereof; and heat insulation means arranged on the nozzle so as to cover at least an area where the gate cut portion is formed.

The temperature measurement means detects the temperature of the gate cut portion and sends the result of detection to the heating controller. The heating controller compares for example a preset temperature with the detected temperature, and if it is judged that the temperature of the gate cut portion is lower than the preset temperature, outputs a command signal to the heating means so as to heat the nozzle. This allows the temperature of metal in the gate cut portion to be kept at a certain level or more, making it possible to rapidly melt the metal in the gate cut portion by a slight heating upon the next injection molding, rendering the metal injectable.

The heat insulation means reduces the quantity of heat migrating from the gate cut portion to the mold. The reason for the provision of such heat insulation means is as follows.

If the gate cut portion and the gate portion near the gate cut portion are in contact with the mold, then a greater quantity of heat will be radiated from the metal in the gate cut portion to the mold. For this reason, even though the heating means applies heat to the nozzle to keep the temperature of the metal in the gate cut portion at a certain level or more, a lot of quantity of heat will be migrated toward the mold, making it difficult to keep the temperature at a certain level. Additional thermal energies will be needed for heating. Particularly, even in the cases where a remarkably increased difference exists between the temperature of metal within the nozzle runner and the temperature of metal in the gate cut portion, with the temperature of the metal in the gate cut portion being lower than the melting point of that metal, the temperature of metal in the runner may exceed the melting point under the operating of the heating means, with the result that high-temperature molten metal in the runner may fuse the metal in the gate cut portion and leak out from the nozzle tip or may be ejected therefrom. Thus, in order to obviate the above deficiencies by reducing the variance of temperature between the interior of the nozzle, especially, the gate cut portion and the runner, the heat insulating means is disposed around the gate cut portion including a part of the gate.

The heat insulation means can be in the form of a gap defined between the mold and the nozzle and filled with air, ceramic or the like.

It is desirable to position the gate-cut portion as closer as possible to the cavity. However, the temperature of the metal in the gate cut potion decreases drastically by bringing the gate cut portion to the cavity and the movable mold whose temperature is low. Accordingly as the gate cut portion comes closer to the cavity, it comes closer to a low-temperature product in the cavity or to the low-temperature movable mold plate, resulting in a rapid drop of the temperature of the metal in the gate cut portion. It is therefore desirable to select a position as closer as possible to the cavity and a position allowing the temperature of metal in the gate cut portion to be kept at an appropriate level after the gate cutting.

In case of heating of the nozzle by the heating means, the further away from the heating means it goes, the lower the temperature of the metal becomes, whereas the closer to the nozzle tip it comes, the larger the rate of drop of the metal temperature becomes. Thus, in the nozzle of the present invention, the position of the gate cut portion is determined in accordance with the gate cut portion position determination manner which will be described later. In case of the nozzle having the thus determined gate cut portion, it is preferred to keep the metal temperature at any temperature in the range of 400° C. to 580° C. when the metal is magnesium alloy for example.

If the temperature of metal in the gate cut portion is higher than the upper limit of this range, the metal in the nozzle runner heated by the heating means may reach a temperature exceeding the melting point, with the result that the molten metal may possibly leak out of the gate cut portion. On the contrary, if the temperature is lower than the lower limit of this range, it will take more time to melt the metal solidified in the vicinity of the gate cut portion, resulting in an elongated cycle time of the injection molding, which will make it unsuitable for the practical use.

When the molten metal is a magnesium alloy, the present inventors have determined the optimum position and hold temperature of the gate cut portion in accordance with the manner which will be described later.

As a result, it has been proved that the gate cut portion should be positioned in substantially the middle region between the nozzle tip and the leading end portion of the induction heating coil. After repeated trial and error, it has been proved that the solidified state of metal in the gate cut portion can stably be held at the temperature near the melting point while keeping the metal in the nozzle runner in its molten state upon the mold opening, by providing a control of the heating temperature so as to allow the temperature of the magnesium alloy in the gate cut portion to exist in the range of 520° C. to 560° C.

It is thus possible for the magnesium alloy to be injection molded at an optimum cycle time, thereby eliminating any risk of leakage of the molten metal out of the gate cut portion upon the mold opening.

In place of the heat insulation means or in conjunction with the formation of the heat insulation means, the nozzle body may be made of ceramic, the periphery of the nozzle being covered with a metallic outer tube, the metallic outer tube having an induction heating coil wound therearound such that molten metal is flown into a gap defined between the outer tube metal and the ceramic nozzle body.

According to this construction, the nozzle body is formed of ceramic having a low thermal conductivity, so that it is possible to reduce the quantity of heat conducted from the molten metal in the gate to the mold and to thereby suppress the drop of temperature of metal in the gate. A further effectiveness is achieved by the formation of the heat insulation means around the nozzle.

In this case, a difference exists in the thermal expansion coefficient between the metal forming the fixed mold plate and ceramic forming the nozzle, so that there may be formed a gap between the fixed mold plate and the nozzle upon the injection of molten metal into the cavity, which may possibly result in a backflow of the molten metal in the cavity into the gap.

This is the reason why the gap is formed between the nozzle and the fixed mold plate so that molten metal fills up this gap. Formation of a hole leading to the gap in the nozzle enables the filling of the molten metal to be effected simultaneously with the injection of metal. The molten metal filled into the gap has the effect of not only preventing a backflow thereof from the cavity as a result of blockage of the gap, but also effectively conducting the heat from the heating means through the metallic outer tube to the nozzle.

Heat radiation means may be disposed on the nozzle at the tip thereof so as to accelerate heat radiation from the metal upon the mold opening. The heat radiation means may be in the form of a member having a high heat radiating property affixed to the tip of the nozzle or in the form of a cooling air flow passage formed at the tip of the nozzle.

Provision of such heat radiation means can accelerate a rapid solidification of metal in the nozzle tip portion upon the mold opening. On the other hand, the periphery of the gate cut portion is heat insulated by the heat insulation means so that the metal in the gate cut portion is kept at a certain temperature or above. This enables the position of the gate cut portion to come as closer as possible to the nozzle tip.

In the mold, the position of the gate cut portion is determined in accordance with the gate cut portion position determination manner which follows.

The manner comprises the steps of disposing heating means for heating metal existing in the nozzle, at any position on the nozzle; disposing a plurality of temperature measurement points for measuring the temperature of the metal existing in the nozzle, at a predetermined interval, in a region from the tip of the nozzle to the heating means; selecting at least one temperature control target point as the reference for the temperature control, out of the plurality of temperature measurement points; providing a control of the heating means upon the mold opening such that metal in at least a portion provided with the heating means is put in molten state and that the temperature of the temperature control target point is kept at a constant level which is lower than the melting point of the metal; measuring the distribution of temperatures of the other ones of the plurality of measurement points when the temperature of the temperature control target point is kept constant; determining, from the results of the measurement, an optimum temperature region where the solidified state of the metal is stably maintained upon the mold opening and where the temperature of the metal solidified is closest to the melting point of the metal; and setting a gate cut portion within the optimum temperature region.

It is preferred upon the creation of a temperature distribution graph of the plurality of temperature measurement points based on the results of the measurement that conditions are appropriately selected including the positions of the nozzle, nozzle heat radiation means, nozzle heat insulation means or heating means so as to ensure that the temperature distribution graph has at least one portion where the gradient of the graph becomes gentle or substantially flat so that the substantially flat portion is defined as the optimum temperature region.

The temperature gradient can be controlled by providing various heat insulation means or by providing heat radiation means.

When the molten metal is a magnesium alloy, the optimum temperature region is preferably controlled so as to lie within the range of 520° C. and 560° C. by use of the heat insulation means or the heat radiation means.

According to another example of the mold for the hot-runner injection molding machine, there is provided a mold which includes a movable mold plate having a cavity and which includes a fixed mold plate having a nozzle for injecting molten metal into the cavity and having heating means for heating metal existing in the nozzle, the mold comprising an ejector pin disposed on the movable mold plate, the ejector pin capable of traversing the cavity to project up to the gate cut portion; a driver arranged to advance and retreat the ejector pin between the protruded state and the retracted state; and drive control means for providing a control of drive of the driver.

This construction enables the gate cut portion to be compulsorily opened by the ejector pin previous to the metal injection.

The drive control means outputs a command allowing the ejector pin to project when the temperature of metal in the gate cut portion reaches a predetermined temperature after the mold closing.

Thus, by allowing the ejector pin to project to compulsorily open the gate cut portion when the temperature of the metal solidified in the gate cut portion has reached a preset temperature, e.g., 500° C. in case of magnesium alloy having the melting point of 596° C., after the mold closing, it is possible to shorten the cycle time of the hot-runner injection molding and to easily manage the temperature of the gate cut portion.

BEST MODE FOR CARRYING OUT THE INVENTION

Preferred embodiments of a mold for a hot-runner injection molding machine of the present invention will be described in detail with reference to the drawings.

In the following description, metal to be injection molded is a magnesium alloy having a melting point of 596° C. (e.g., ASTM standards; AZ91D).

[First Embodiment]

Figure 1:
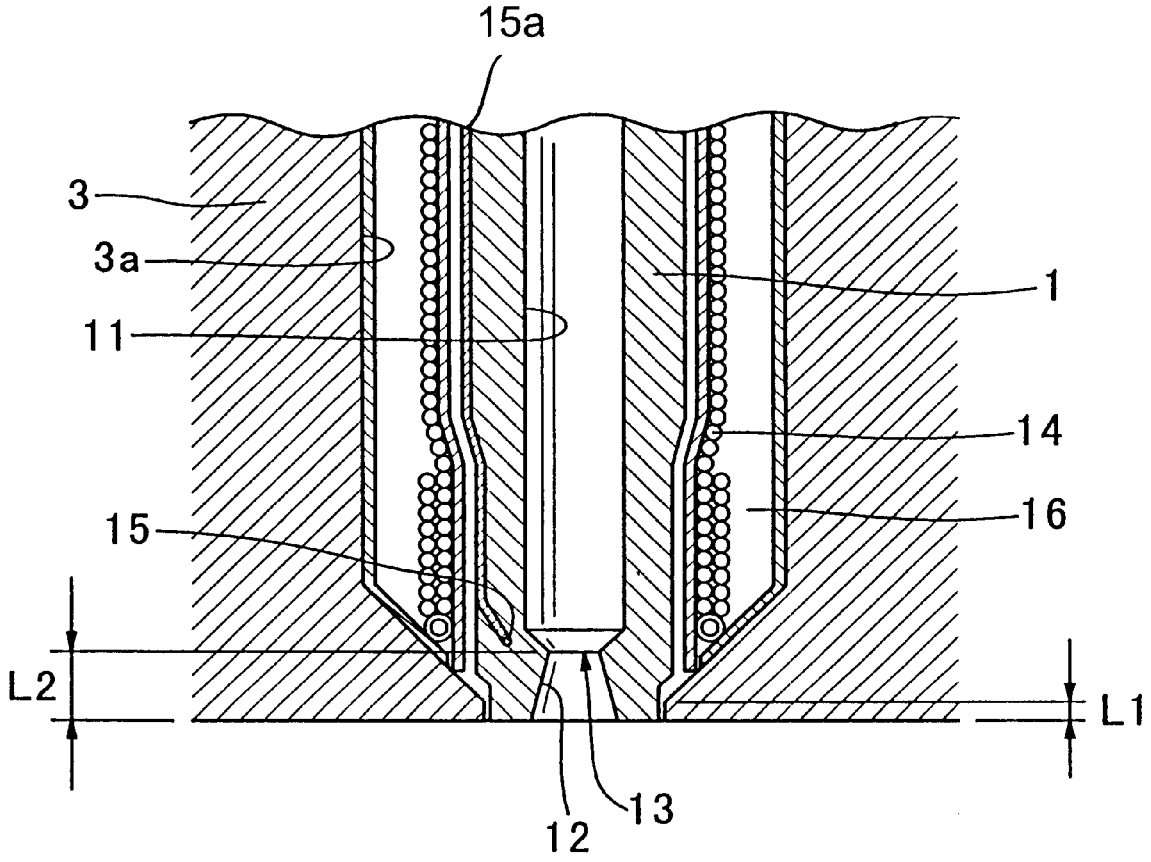
FIG. 1 is a partially enlarged sectional view of a nozzle in accordance with an embodiment of the present invention.

FIG. 1 is an enlarged sectional view of a nozzle section of the mold for the hot-runner injection molding machine, constructed in accordance with a first embodiment of the present invention.

As shown in FIG. 1, a nozzle 1 is inserted in a nozzle bearing hole 3*a* formed in a fixed mold plate 3. The nozzle bearing hole 3*a* has a larger hole diameter than the outer diameter of the nozzle 1 so as to define a space 16 between the nozzle 1 and the fixed mold plate 3. In order to bear the tip of the nozzle 1 on one surface (surface abutting against a movable mold plate 4) of the fixed mold plate 3, the hole has a reduced diameter from the midway portion toward the one surface.

The space 16 is filled with air so that air and the space 16 cooperatively provide heat insulation means. It is natural that the heat insulation means could be other gases than air, e.g., nitrogen gas, or that a ceramic outer tube might be fitted around the nozzle 1 to provide the heat insulation means.

An induction heating coil 14 acting as heating means is wound around a runner 11 formed in the nozzle 1. A small-diameter portion defined between a gate 12 and the runner 11 of the nozzle 1 is in the form of the gate cut portion 13 for separating a product from the nozzle 1 when the mold is opened. A temperature sensor 15 is implanted in the vicinity of the gate cut portion 13, for measuring the temperature of metal existing in the gate cut portion 13. Results of measurement effected by the temperature sensor 15 are fed via a lead wire 15*a* to a heating controller (not shown).

The heating controller compares a detected temperature of metal existing in the gate cut portion 13 with a preset temperature of the gate cut portion 13, to control a voltage to be applied to the induction heating coil 14. If the detected metal temperature is lower than the preset temperature, then the heating controller outputs a command signal to build up the voltage applied to the induction heating coil 14 to a predetermined voltage to thereby heat metal within the runner 11, thus raising the temperature of metal existing in the gate cut portion 13. When the temperature of metal in the gate cut portion 13 reaches the preset temperature, the voltage is dropped to the predetermined voltage.

The gate cut portion 13 is formed in the region where the space 16 is defined. At that time, a part of the gate 12 adjacent to the gate cut portion 13 is also located in the region of the space 16. Let L1 be the length of contact of the nozzle 1 with the fixed mold plate 3, L2 is set so as to meet the relationship L1<L2 where L2 is the distance from one surface of the fixed mold plate 3 where the tip of the nozzle 1 is located to the gate cut portion 13. The distance L2 up to the gate cut portion 13, i.e., the position of the gate cut portion 13 can be determined as follows.

Figure 2A:
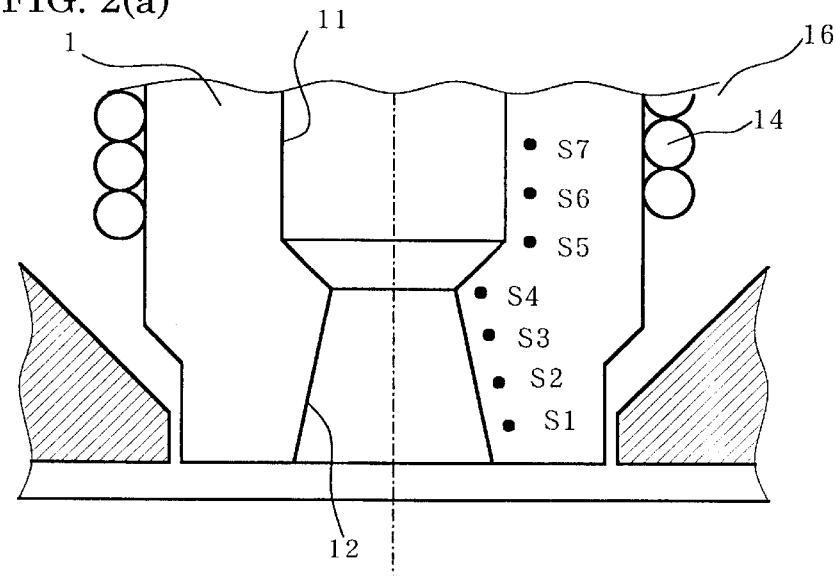
FIG. 2(*a*) is a partial sectional view of the tip of the nozzle 1 serving as a model for determining the position of a gate cut portion 13, and FIG. 2(*b*) is a graphical representation showing a temperature distribution for each temperature control target point set temperature.
Figure 2B:
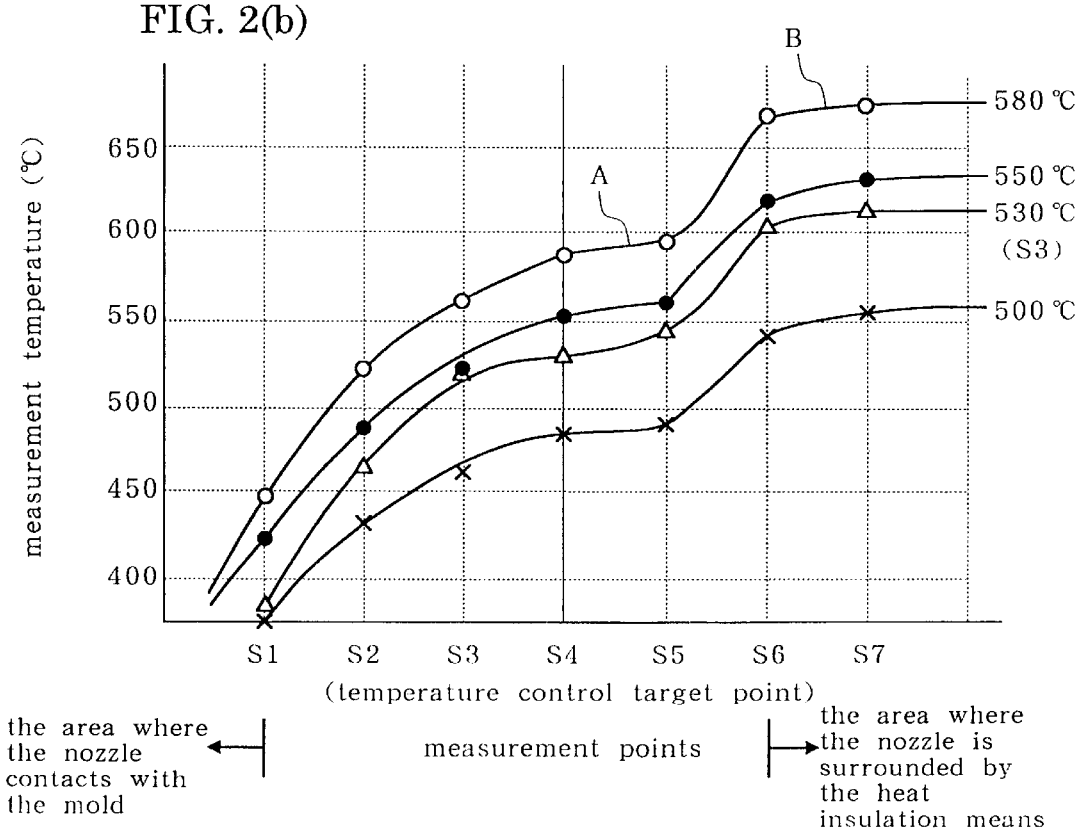

FIG. 2(*a*) is a partial sectional view of the tip of the nozzle 1 serving as a model for determining the position of the gate cut portion 13.

First, as shown in FIG. 2(*a*), a plurality of (e.g., seven) measurement points S1 to S7 are provided at a predetermined interval (e.g., at 1 mm interval) along the axial direction of the nozzle 1 from the extremity of the nozzle 1 serving as the model. It is preferred that the measurement points S1 to S7 be provided as close as possible to the inner periphery of the gate 12 and the runner 11 so as to be able to measure the actual temperature of metal existing in the nozzle 1. The temperature sensor is implanted in each measurement point thus provided. Selection is arbitrarily made as a measurement point for the reference of the heating control effected by the heating controller. The heating controller is set so as to ensure a constant temperature at this measurement point (hereinafter referred to as a temperature control target point). Then, set temperatures of the heating controller are variously altered so that temperature distributions at the measurement points are obtained in graphical representation depending on the set temperatures.

FIG. 2(*b*) shows a graph of the temperature distributions at the measurement points S1 to S7 depending on the set temperatures. This graph has the axis of ordinates representative of the measurement temperature (° C.) and has the axis of abscissas representative of the measurement points S1 to S7.

In the model shown in FIGS. 2(*a*) and 2(*b*), the measurement point S4 is selected as the temperature control target point (hereinafter, the measurement point S4 is stated particularly as a temperature control target point S4). Then, the set temperatures of the heating controller are varied in such a manner that the metal temperature at the temperature control target point S4 results in 500° C., 550° C. and 580° C.

Measurements were then made for the temperatures at the temperature control target point S4 and the other measurement points S1 to S7 upon the mold opening and the results were plotted in the graphical representation.

In the thus obtained graphical representation, there appeared regions A and B in which curves have small gradients or are gentle. The region A is an area which is surrounded by heat insulation means and which contains the temperature control target point S4 whose temperature is substantially constant under the control of the heating controller. The region B is an area where metal within the nozzle 1 is directly heated by the induction heating coil 14. Leftward from the region A, i.e., toward the extremity of the nozzle 1, the graph has a larger descending gradient. This is because heat is rapidly absorbed by the product within the cavity and by the mold in contact with the nozzle 1.

When the set temperature is 580° C., the temperature in the region A is of the order of 580° C. which is slightly lower than the melting point, although the temperature in the region B is raised to about 670° C. by direct heating of the induction heating coil 14. In this set temperature, the provision of the gate cut portion 13 in the region A may allow metal in the gate cut portion 13 to easily melt due to presence of high-temperature metal within the runner 11, which may possibly result in a leakage of molten metal from the tip of the nozzle 1.

When the set temperature is lowered to 550° C., the temperature in the region B results in about 630° C. which is slightly higher than the melting point. The metal temperature in the region A is of the order of 550° C., and the temperature of molten metal in the region B is not so higher than the melting point, either, whereupon the solidified state can stably be kept in the region A. Thus, there is no fear of any leakage of the molten metal irrespective of the provision of the gate cut portion 13 in the region A.

When the set temperature is lowered to 500° C., the temperature of metal in the region B becomes lower than the melting point, so that the metal within the runner 11 becomes substantially solidified. It is therefore presumed at this set temperature that considerable heating time is needed for the next injection.

Triangular plot points of FIG. 2(*b*) represent a graph obtained in cases where the measurement point S3 has been selected as the temperature control target point in place of the measurement point S4 at the set temperature of 530° C. The thus obtained graph was approximate to the graph obtained at the temperature control target point S4 when the set temperature was 550° C.

FIGS. 2(*a*) and 2(*b*) showed the cases where the control target temperatures were 500° C., 550° C. and 580° C. at the temperature control target point S4. Similar graphs are created for the remaining measurement points S1 to S7. It would further be preferred to subdivide the set temperatures at the temperature control target points S1 to S7 to make measurements.

From the thus obtained results, the gate cut portion 13 may be disposed in, or preferably at substantially the middle of, the region A between the measurement point S6 where the heating induction coil 14 starts to be wound and the measurement point S1 where the tip of the nozzle 1 is in contact with the fixed mold plate 3.

As seen in FIG. 2(*b*), the region A is an area having a small gradient which is substantially flat. Accordingly as the gradient of the graph becomes smaller, it is subjected to less influence irrespective of some variance of the temperature of molten metal within the nozzle 1. This means that a flatter gradient of the graph indicates the state of metal to be kept in a stabilized manner. In this embodiment, the region A is an optimum temperature region for providing the gate cut portion 13. The gate cut portion 13 is preferably disposed at substantially the middle of the region A, e.g., at or near the measurement point S3 or S4 which is the target point for the temperature control effected by the heating controller. The control target temperature can be of the order of 530° C. (within the range of 520° C. to 540° C.) when the gate cut portion 13 has been disposed at or near the measurement point S3, and of the order of 550° C. (within the range of 540° C. to 560° C.) when the gate cut portion 13 has been disposed at or near the measurement point S4. In this embodiment, the gate cut portion 13 was disposed at substantially the middle between the measurement points S1 and S6, with the heating controller being set so as to keep the temperature of the metal in the gate cut portion at 520° C. to 560° C., whereby satisfactory injection molding results were obtained.

It is to be noted that the position of the gate cut portion 13 differs depending on the temperature of the mold, the hole diameter of the gate cut portion 13 of the nozzle 1, the length of contact of the mold with the nozzle 1, the material (thermal conductivity) and the thickness of the nozzle 1, the position to dispose the heat insulation means and the form of the heat insulation means, the position to dispose the induction heating coil 14 on the nozzle 1, and the thermal capability of the induction heating coil 14, so that it is preferred upon the design of the nozzle 1 to make measurement for each condition in order to determine the optimum position in the same manner as the above.

In this case also, the temperature distribution graph is created as shown in FIG. 2(*b*) although the gentle portion in the preferred form as indicated in FIG. 2(*b*) may not appear in the temperature distribution graph depending on the conditions. In such an event, some conditions such as the position of the heating coil 14 may be altered so that the graph can have the gentle portion in the preferred form close to the flatness as much as possible.

Figure 3:
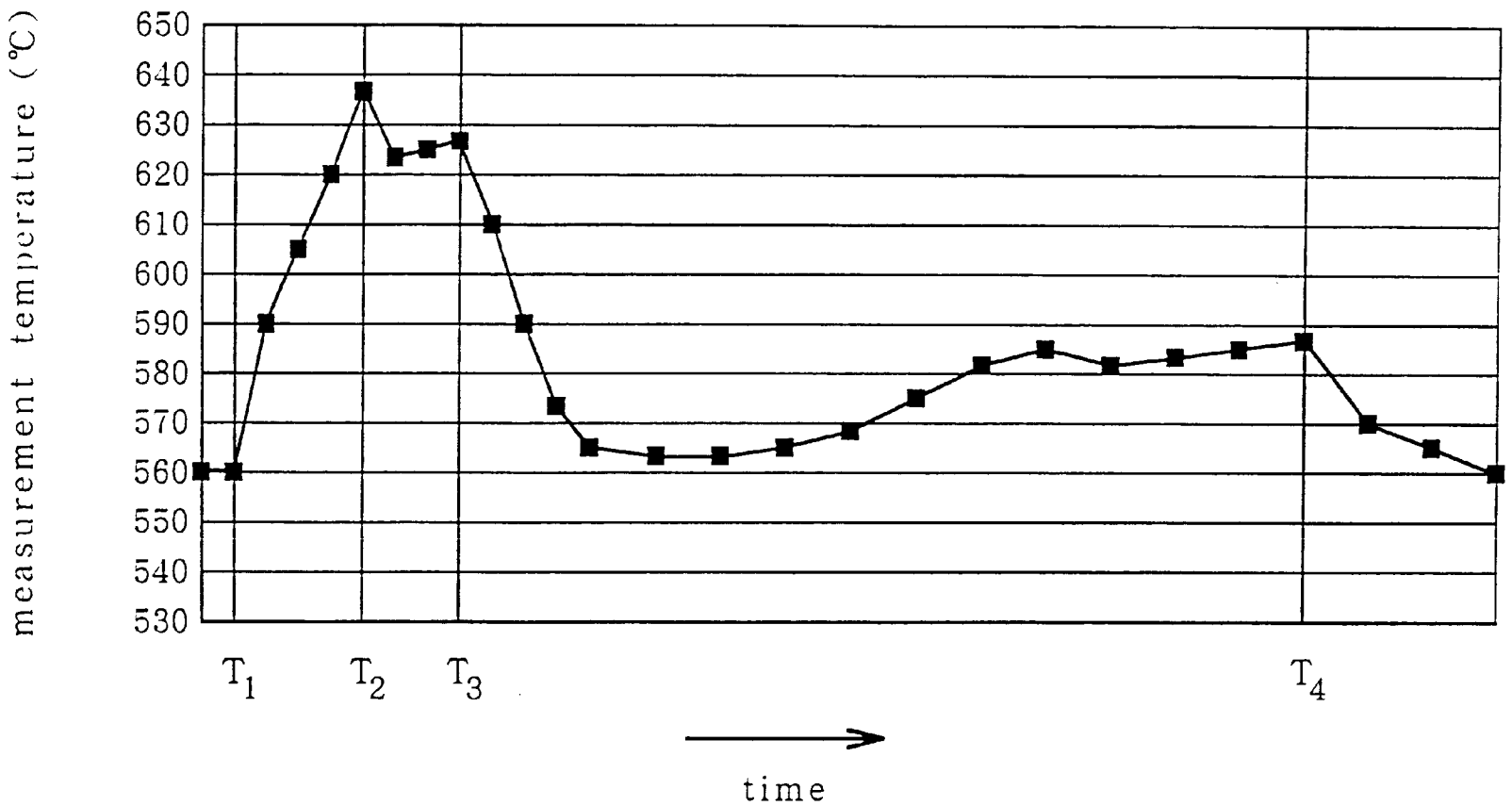
FIG. 3 is a graphical representation showing variations in temperature at a gate cut position in case of magnesium alloy injection molding with the nozzle whose gate cut position has been determined on the basis of the graphical representation of FIG. 2(*a*).

FIG. 3 shows a temperature variation graph obtained when magnesium alloy has actually been injection molded by use of the mold having the gate cut portion whose position has been determined in the above manner.

In the mold opening state anterior to the time T1, the temperature sensor implanted in the nozzle 1 in the vicinity of the gate cut portion indicates 550° C. The melting point of the magnesium alloy is 596° C. and the gate cut portion is disposed in the optimum temperature region, so that the solidified state can stably be kept during the mold opening.

At the time T1, the mold is closed to execute the injection molding and the nozzle 1 is heated by an induction heating coil 24. After the elapse of a relatively short period of time, i.e., at the time T2, the temperature sensor indicates the gate cut portion temperature 630° C. which is higher than the melting point. Thus, at the time T3, metal in the gate cut portion melts rapidly, rendering the mold openable.

Afterward, at the time T3 when the heating by the induction heating coil 24 is halted or immediately before the halt, the magnesium alloy is injected. As a result of the halt of the heating, the temperature of the metal in the gate cut portion may slightly fall, but nevertheless the gate cut portion is easily opened by the high-temperature metal lying behind the nozzle 1 and by the injection pressure. The injection time terminates in approx. 0.04 sec.

Subsequently, till the time T4 when the mold is opened, the mold closing state is kept to solidify the metal existing in the cavity. The gate cut portion is controlled by the operation of the temperature controller so as to be of the order of 560° C.

[Second Embodiment]

A second embodiment of the present invention will then be described with reference to FIGS. 4 and 5.

Figure 4:
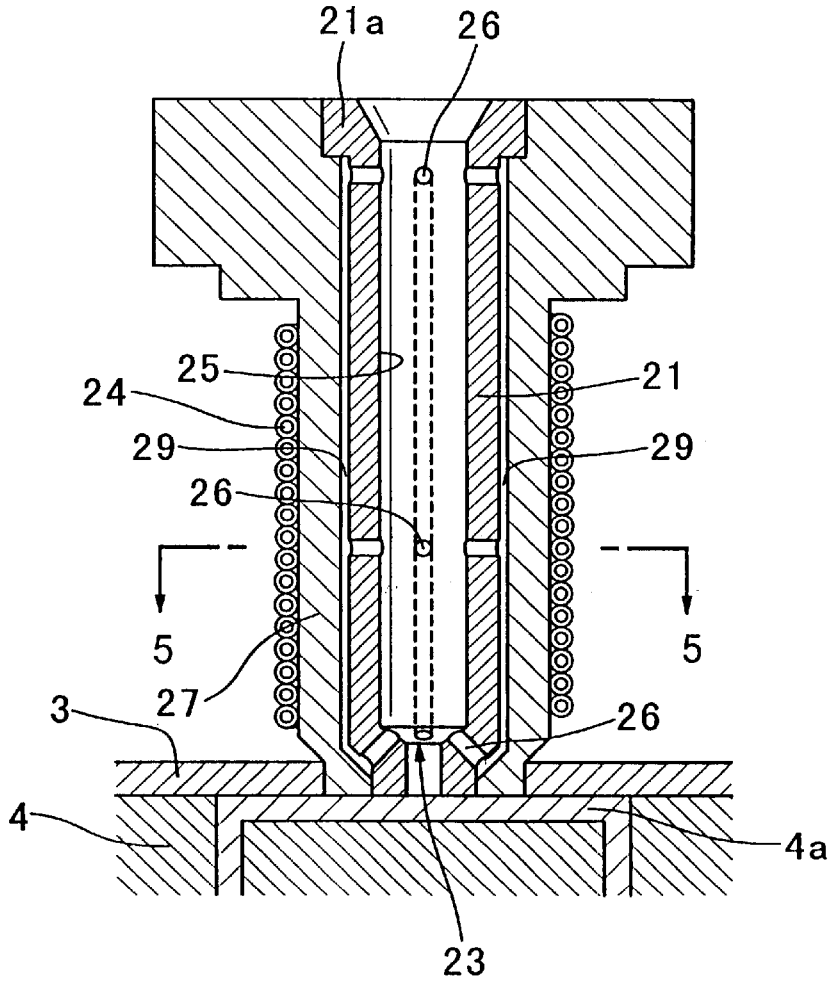
FIG. 4 is a sectional view of a nozzle in accordance with a second embodiment of the present invention, the nozzle being mounted to a fixed mold plate.
Figure 5:
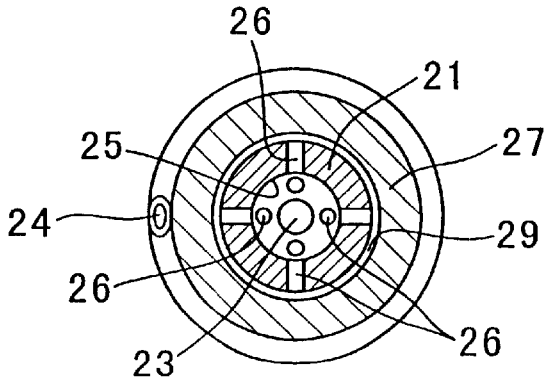
FIG. 5 is a sectional view of the nozzle of FIG. 4 taken along a line 5—5 in FIG. 4.

FIG. 4 is a sectional view of the nozzle in accordance with the second embodiment, and FIG. 5 is a sectional view of the nozzle of FIG. 4 taken along line 5—5.

The second embodiment differs in the form of the heat insulation means from the first embodiment. That is, the nozzle 21 is made of ceramic and is surrounded by a metallic outer tube 27. The induction heating coil 24 is wound around the periphery of the outer tube 27.

In this embodiment also, a temperature sensor (not shown) is disposed in the vicinity of the gate cut portion 23. In the same manner as the foregoing embodiment, a heating controller (not shown) provides a control of the operation of the induction heating coil on the basis of the results of measurement effected by the temperature sensor.

A minute gap 29 is defined between the outer tube 27 and the nozzle 21. The minute gap 29 is formed to have the width of substantially zero at the normal temperature. That is, this gap 29 is a gap formed as a result of difference in the thermal expansion between the metal and ceramic when the metal (magnesium alloy) has been flown into the nozzle 21. The gap 29 has one end blocked by a flange 21*a* of the nozzle and has the other end opening from the tip of the nozzle 21 toward the exterior of the fixed mold plate 3.

This form allows metal within the runner 25 to be filled through a hole 26 into the gap 29 to thereby prevent a back of metal from the cavity 4*a*. Air within the gap 29 is expelled so that the gap between the metallic outer tube 27 and the ceramic nozzle 29 is filled with metal (magnesium alloy) having a high thermal conductivity, whereby heat generated by the induction heating coil 24 can effectively be conducted to the nozzle 21.

In this embodiment also, in the same manner as the foregoing embodiment, the temperature of metal is measured from the tip of the nozzle 21 so that the graph as shown in FIG. 2(*b*) is created to find the optimum temperature region so that the gate cut portion 23 is disposed at that location.

Referring to a graph of FIG. 6, description will be made for a method of determining the position of the gate cut portion 23 in this embodiment.

In this embodiment, the nozzle 21 is made of ceramic having a low thermal conductivity, and hence it is impossible to intactly use the manner as set forth in FIG. 2(*b*) and the foregoing embodiment to thereby determine the position of the gate cut portion 23. The reason is that as shown by a graph 1 in FIG.6 (indicated by a chain dotted line), if the measurement point S4 is selected as the temperature control target point at the set temperature of e.g., 500° C., insufficient heating of metal within the runner 25 will cause solidification of the metal. Attempt to always keep the metal within the runner 25 in the molten state necessitates a raise of the set temperature of the temperature control target point S4 up to 580° C as seen in a graph II of FIG. 6, which is unsuitable for practical use.

From the above description, it is easily judged that the temperature control target point must be moved toward the tip side of the nozzle 21 in case of the nozzle having high heat insulating properties like the nozzle 21.

Figure 6:
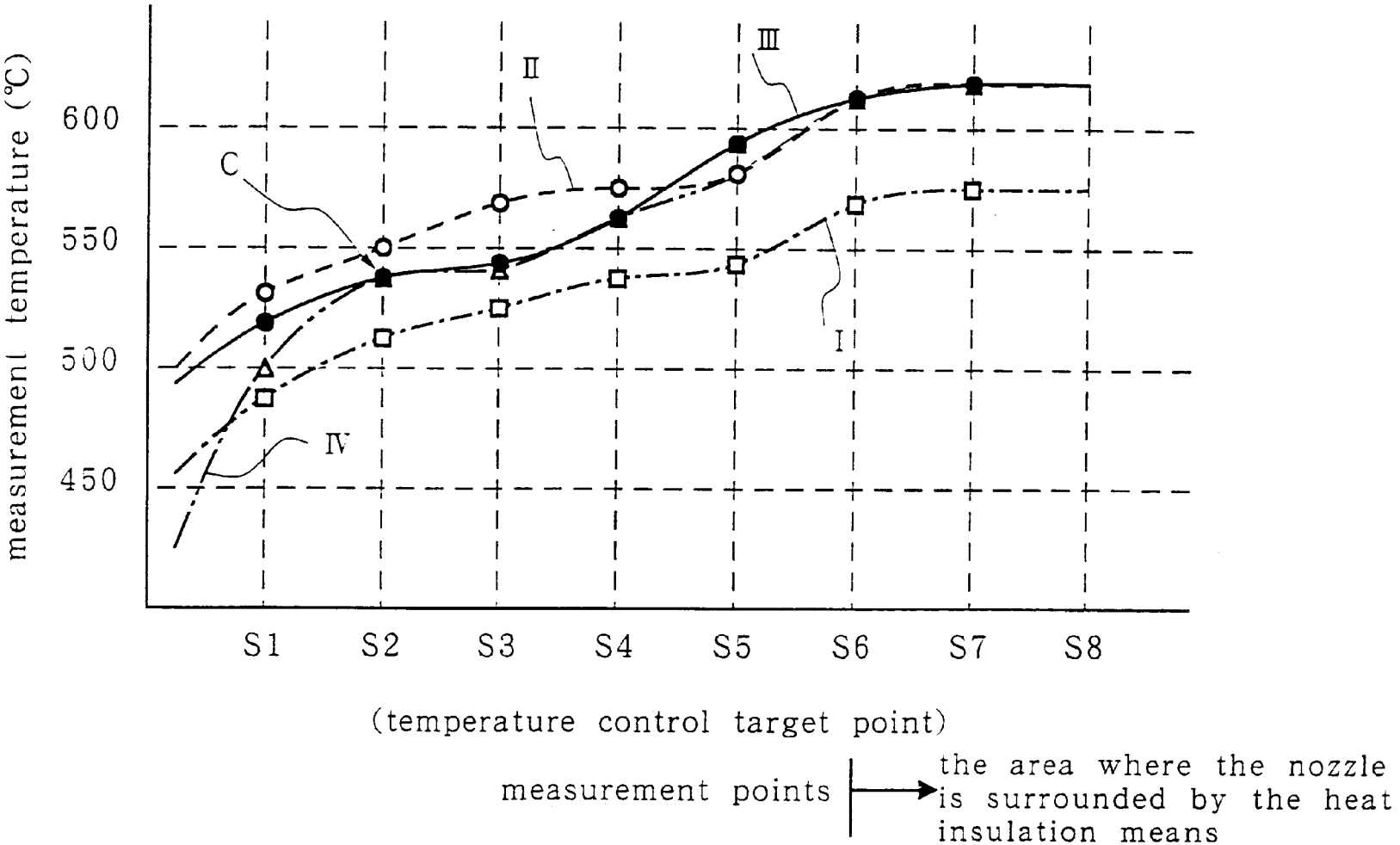
FIG. 6 is a graphical representation explaining the manner for determining the position of the gate cut portion in the second embodiment of the present invention.

As shown in a graph III of FIG. 6, if the measurement point S2 is selected as the temperature control target point at the set temperature of 550° C., then there will appear a gently sloped region which is nearly flat at or near the temperature lower than the melting point in the vicinity of the temperature control target point S2. At that time, the metal at the portion having the induction heating coil 24 wound therearound is kept at approx. 630° C. which is an appropriate temperature capable of maintaining the molten state. It can therefore be understood that the gate cut portion 23 is to be positioned in the region C where the graph III comes to have a smaller gradient which is nearly flat. More specifically, the gate cut portion 23 can be disposed at the measurement point S2 for example.

This means that improved heat insulating properties of the nozzle 21 enable the position of the gate cut portion 23 to come closer to the cavity 4*a*.

In the event that it is impossible to stably keep the solidified state of the metal upon the mold opening since the temperature gradient of metal within the nozzle 21 is gentle in spite of a movement of the temperature control target point toward the tip of the nozzle 21 with the heat insulation means having a high heat insulating property, heat radiation from the tip of the nozzle 21 may be promoted so as to intentionally increase the temperature gradient.

An example of the heat radiation means will be described with reference to FIGS. 7(*a*) and 7(*b*).

Figure 7A:
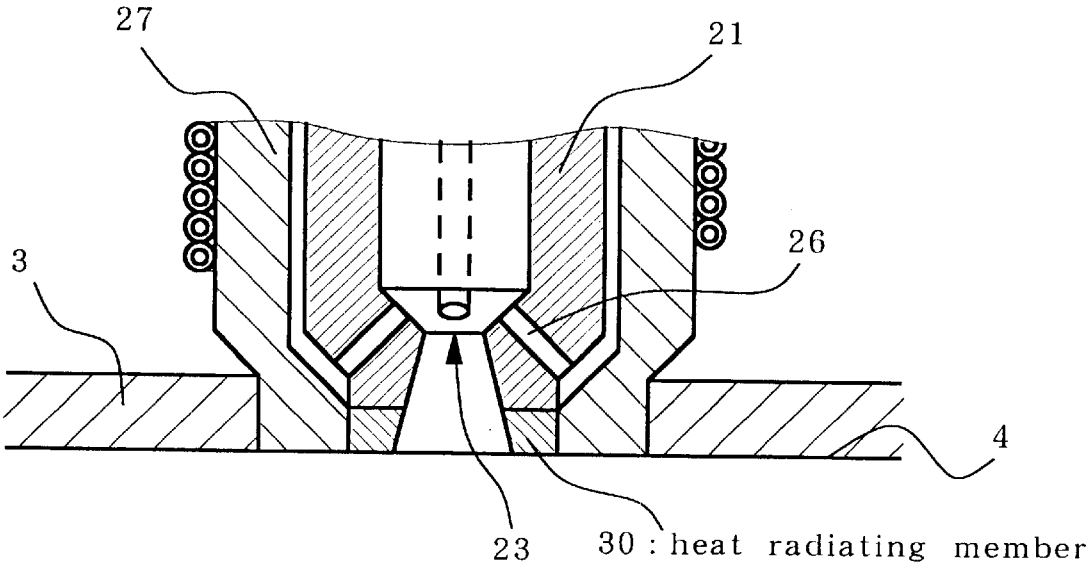
FIGS. 7(*a*) and 7(*b*) are partial sectional views of the nozzle tip, showing an example of heat radiation means disposed at the nozzle tip.
Figure 7B:
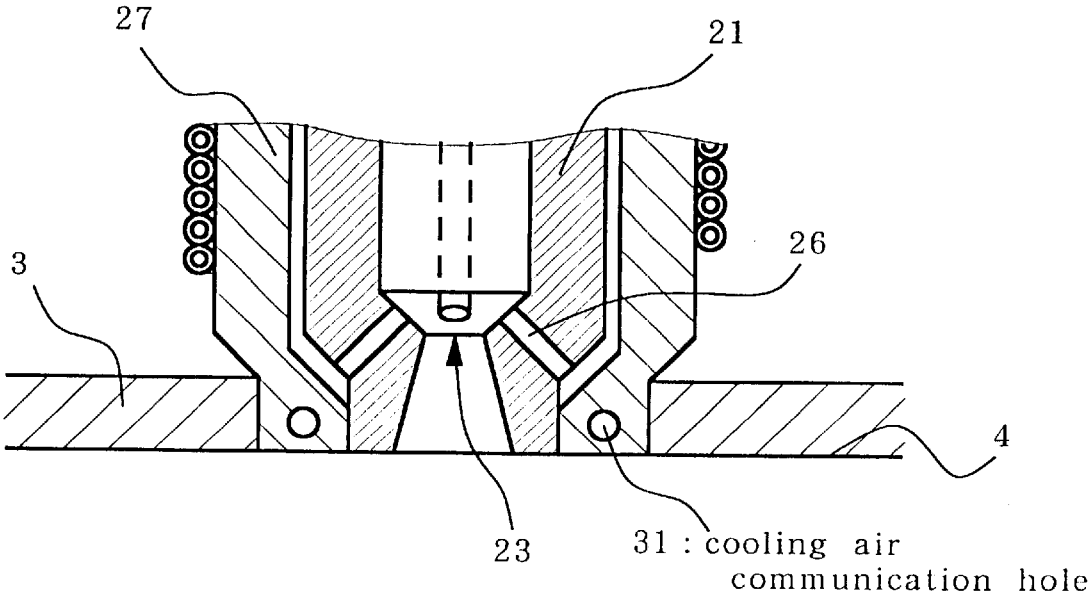

The heat radiation means of FIG. 7(*a*) comprises a heat radiating member 30 made of, e.g., metal having a high thermal conductivity and affixed to the tip of the nozzle 21. The heat radiation means of FIG. 7(*b*) comprises a cooling air communication hole 31 formed at the tip of the nozzle 21 so that cooling air can flow through the cooling air communication hole 31.

It is thus possible to obtain the graph like a graph IV of FIG. 6 which indicates the temperature sharply falling at the tip of the nozzle 21.

[Third Embodiment]

A third embodiment of the present invention will then be described with reference to FIG. 8.

Figure 8:
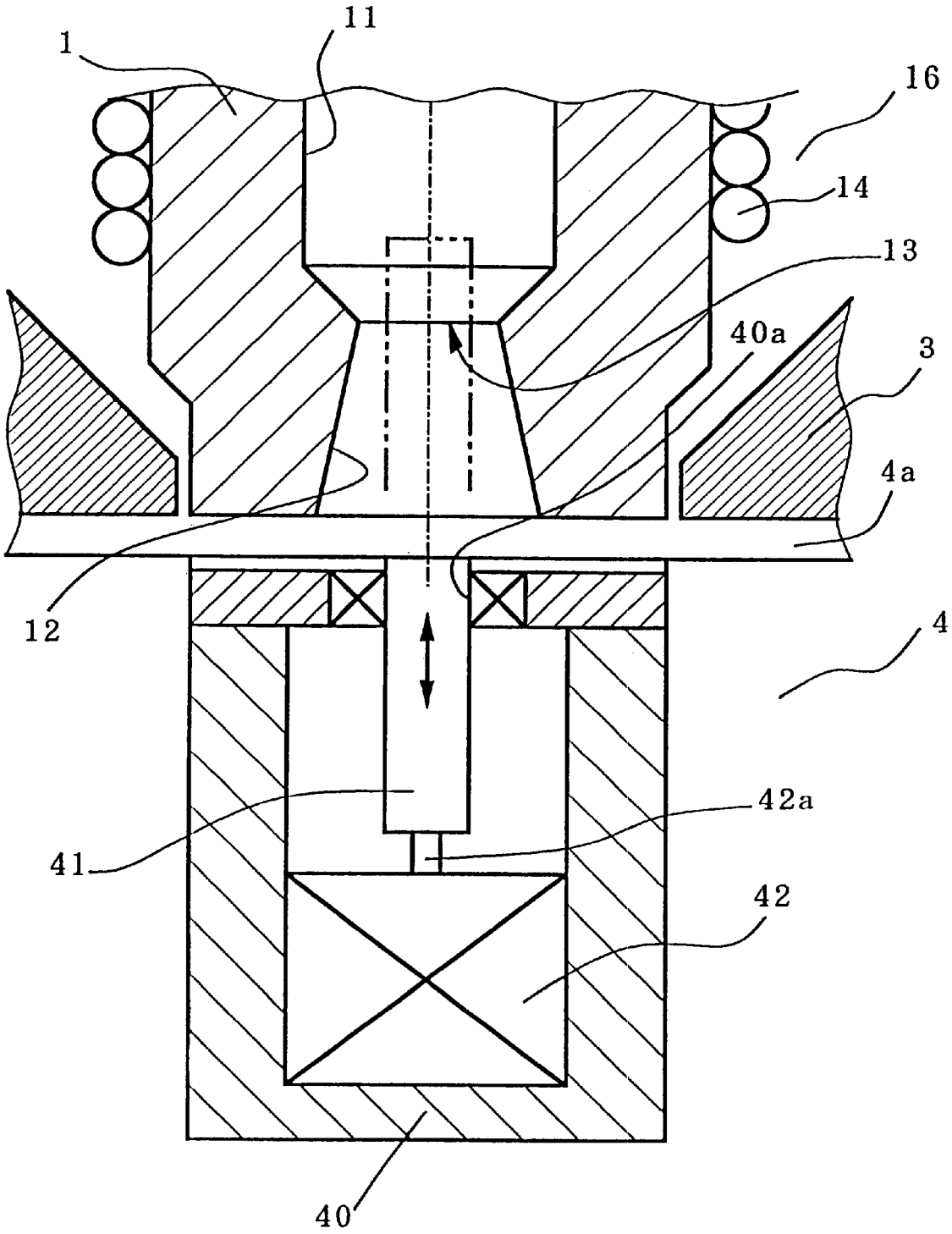
FIG. 8 is an enlarged sectional view of a mold nozzle portion in a third embodiment of the present invention.
Figure 9:
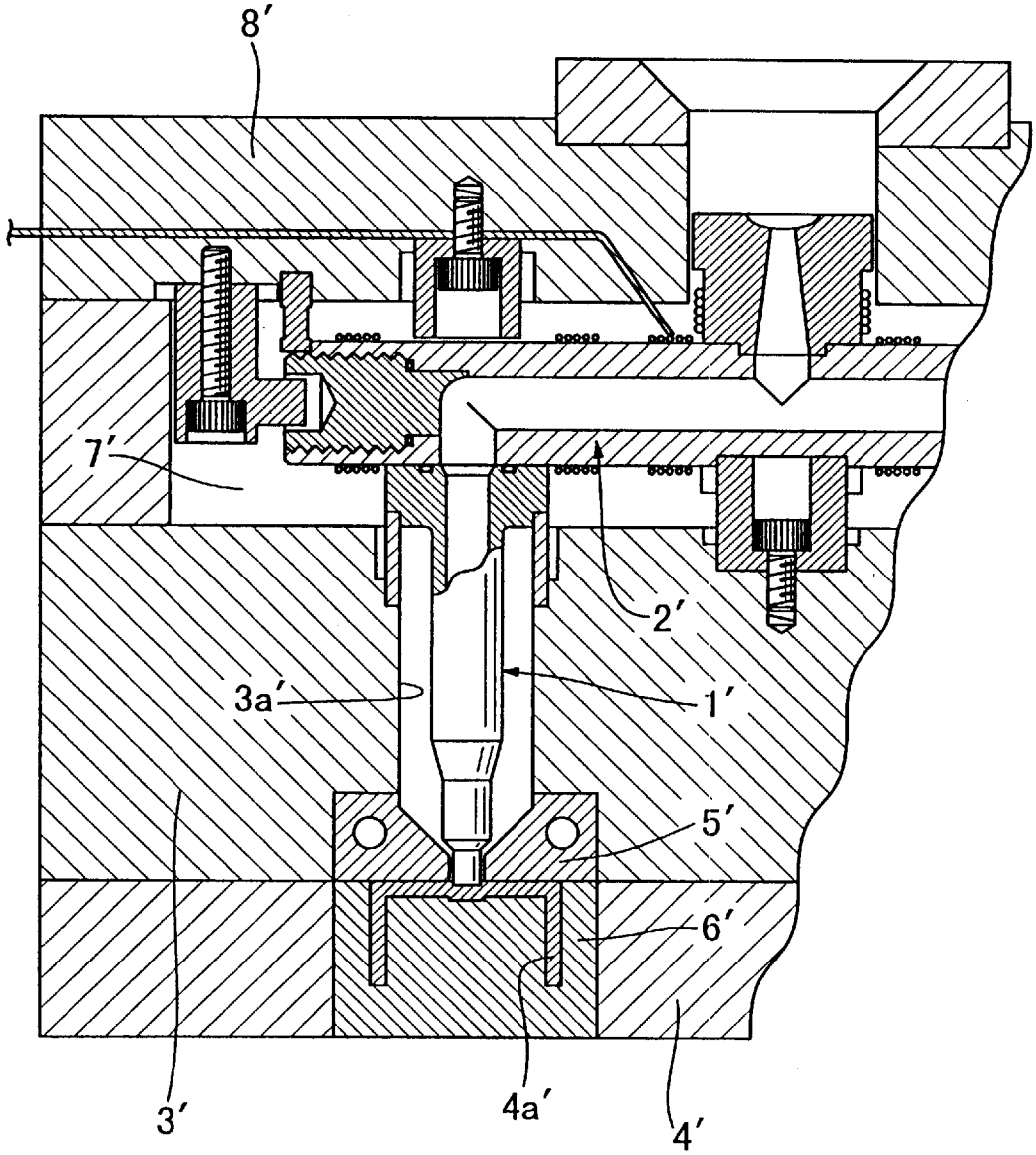
FIG. 9 Prior Art
FIG. 9 is a sectional view of a mold for the hot runner injection molding machine.

FIG. 8 is an enlarged sectional view of a mold nozzle portion in accordance with the third embodiment of the present invention.

In this embodiment, the movable mold plate 4 is provided with a pin 41 that traverses the cavity 4*a* to project up to a position beyond a gate cut portion 33 of the nozzle 31 and with a cylinder 42 acting as the driver for advancing and retreating the pin 41 between the protruded state and the retracted state.

It is to be noted that the nozzle of the fixed mold plate 3 has the same construction as that of the first embodiment and hence that in FIG. 8 the same elements are designated by the same reference numerals and are not again described in detail.

The cylinder 42 is accommodated in a heat-resistant container 40 implanted in the movable mold plate 4. The pin 41 is affixed to a piston rod 42*a* that can freely advance and retreat of the cylinder 42.

It will be understood that the above drive mechanism including the cylinder 42 may be substituted by a known drive mechanism for an ejector pin, provided for compulsorily separating a molded part from the cavity 4*a*.

Coaxial with the gate cut portion 13 of the nozzle 1, a through-hole extends from the cavity 4*a* to the container 40 so that the pin 41 can emerge through the through-hole 40*a* by the drive of the cylinder 42.

The pin 41 projects beyond the gate cut portion 13 up to the runner 11 by the drive of the cylinder 42. Upon the injection molding, the pin 41 moves toward the cavity 4*a* and becomes substantially level with the bottom of the cavity 4*a*. In this state, the injection mold is carried out. The pin 41 is preferably made of ceramic having a high heat resistance and a small thermal expansion coefficient.

The drive of the cylinder 42 is controlled by drive control means (not shown).

The control means outputs a command for causing the pin 41 to protrude when the temperature of the metal in the gate cut portion 13 has reached a predetermined temperature after the mold closing.

This will be described with application to the injection molding of the first embodiment.

When a predetermined voltage is applied to the induction heating coil 14 to heat the nozzle 1 and the temperature of the metal in the gate cut portion 13 exceeds 500° C. for example, the drive control means outputs a command signal to drive the cylinder 42, allowing the pin 41 to protrude. The metal in the gate cut portion 13 has a fair high temperature although it does not completely melt, and hence the gate cut portion can easily be opened by thrusting the solidified portion toward the runner 11 by use of the pin 41.

After the opening of the gate cut portion 13, the pin 41 is accommodated in the movable mold plate 4 by the drive of the cylinder 42 and metal melted down from the nozzle 1 is injected into the cavity 4*a*.

In order to prevent, e.g., a breakage of the pin 41 or a damage to the nozzle 1, the drive control means is preferably provided with a safety-measure part for halting the drive of the cylinder 42 or for halting the operation of the hot-runner injection molding machine when a load exceeding a predetermined level acts on the pin 41.

Although the preferred embodiments of the present invention have been described, the present invention is not intended to be restricted by the above embodiments.

By way of example, in the first embodiment, the measurement point S4 has been selected as the gate cut portion 13 since, with the metal temperature at the fourth measurement point S4 being kept at 550° C., the temperature at the measurement point S4 reaches 580° C. immediately before the mold opening. Instead, however, other any position may be employed as long as it falls in the region A of the graph of FIG. 2.

In case of magnesium alloy (ASTM standards; AZ91D) having the melting point of 596° C., the metal optimum temperature to be kept at the controlled point was 550° C. However, since the optimum temperature differs depending on metals, the optimum temperature has only to be found for each metal to be injection molded. In the event of the other metals (e.g., ASTM standards; AM60B, magnesium alloy having the melting point of 615° C.) having a melting point temperature closer to the melting point temperature of the magnesium alloy as set forth in the above embodiments and having similar nature of metal, the numerical values in the above embodiments should be referred.

According to the present invention, it is possible to keep the metal temperature in the gate cut portion at a certain level or more and to melt the metal in the gate cut portion by a slight heating upon the next injection, to obtain the injectable state. For this reason, cycle time suitable for practical use can be realized. Due to the capability of selectively disposing the gate cut portion at an appropriate position, it is possible to provide a mold for the hot-runner injection molding machine adapted for the magnesium alloy or other metals, free from leakage of the molten metal from the nozzle tip after the mold opening. Industrial Applicability The mold having a gate cut position determined by the method of the present invention is widely applicable not only to the hot-runner injection molding of metals such as magnesium alloy, aluminum alloy and zinc alloy, but also to the hot-runner injection molding of the other sorts of metals.

What is claimed is:

1. A mold for a metal hot-runner injection molding machine, comprising:

a movable mold plate having a cavity;

a fixed mold plate having a nozzle made of ceramic for injecting molten metal into said cavity and having a tip and a passage;

a metallic outer tube covering a periphery of the nozzle to have a gap therebetween such that the molten metal flows into the gap through the passage;

an induction heating coil wound around the metallic outer tube as heating means for heating metal existing in said nozzle situated at a position away from the tip;

a gate cut portion where gate cutting is performed, said gate cut portion being situated in the nozzle between the heating means and the tip such that temperature of the metal in the nozzle upon mold opening can be kept stably to allow the metal in a metal solidified state close to a metal melting temperature;

temperature measurement means arranged adjacent to the gate cut portion for measuring the temperature of the metal in said gate cut portion;

heating control means connected to the heating means for providing a control of heating of said nozzle by said heating means on a basis of a result of measurement by said temperature measurement means, said heating control means controlling the heating means to allow the metal in the nozzle adjacent to the heating means always in a molten state at a time of an operation; and heat insulation means arranged on said nozzle so as to cover at least an area where said gate cut portion is formed, said heat insulation means adjusting a temperature distribution of the metal in the nozzle from a portion where the heating means is formed to the tip of the nozzle.

2. The mold for a metal hot-runner injection molding machine according to claim 1, wherein said molten metal is a magnesium alloy, and said heating control means keeps temperature of said magnesium alloy in said gate cut portion upon the mold opening at a temperature ranging from 400° C. to 580° C.

3. The mold for a metal hot-runner injection molding machine according to claim 2, wherein said heating control means keeps the temperature of said magnesium alloy in said gate cut portion upon the mold opening at a temperature ranging from 520° C. to 560° C.

4. The mold for a metal hot-runner injection molding machine according to claim 1, wherein said nozzle has heat radiation means disposed at the tip thereof so as to accelerate heat radiation from said metal upon the mold opening.

5. The mold or a metal hot-runner injection molding machine according to claim 4, wherein said heat radiation means is a member having a high heat radiating property affixed to the tip of said nozzle or a cooling air flow passage formed at the tip of said nozzle.

6. The mold for a metal hot-runner injection molding machine according to claim 1, wherein said induction heating coil has a multiple coil portion at a tip side of the nozzle.

7. The mold for a metal hot-runner injection molding machine according to claim 1, wherein said gate cut portion is located such that in a condition that the metal in the nozzle adjacent to the heating means is in the molten state at a temperature slightly above the metal melting temperature, a temperature at the gate cut portion is slightly below the metal melting temperature, and a vicinity of the gate cut portion close to and away from the heating means has a temperature close to the temperature at the gate cut portion.

8. The mold for a metal hot-runner injection molding machine according to claim 7, further comprising a space between the nozzle and the heating means.

9. The mold for a metal hot-runner injection molding machine according to claim 1, further comprising:

a pin disposed on said movable mold plate, said pin having a retracted state where a tip of the pin aligns a surface of the cavity and a protruded state where the pin passes through said cavity and enters an inside of the nozzle to project to said gate cut portion;

driving means attached to the ejector pin to advance and retreat said ejector pin between the protruded state and the retracted state; and drive control means connected to the driving means for controlling the same.

* * * * *